US007266890B2

(12) United States Patent
Cieslik et al.

(10) Patent No.: US 7,266,890 B2
(45) Date of Patent: Sep. 11, 2007

(54) METHOD FOR PRODUCING A HEAT EXCHANGER

(75) Inventors: Detlef Cieslik, Giengen (DE); Thorsten Kusnik, Günzburg (DE); Berthold Pflomm, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 103 days.

(21) Appl. No.: 10/973,695

(22) Filed: Oct. 26, 2004

(65) Prior Publication Data

US 2005/0109497 A1 May 26, 2005

Related U.S. Application Data

(63) Continuation of application No. PCT/EP03/04338, filed on Apr. 25, 2003.

(30) Foreign Application Priority Data

Apr. 26, 2002 (DE) ..... 102 18 826

(51) Int. Cl.

| | |
|---|---|
| ***B21D 39/06*** | (2006.01) |
| ***B21D 53/00*** | (2006.01) |
| ***B21D 53/02*** | (2006.01) |
| ***B23P 15/26*** | (2006.01) |

(52) U.S. Cl. ..... 29/890.038; 29/890.03; 165/171

(58) Field of Classification Search ..... 29/890.038, 29/890.03; 165/171

See application file for complete search history.

(56) References Cited

U.S. PATENT DOCUMENTS

| | | | | |
|---|---|---|---|---|
| 1,982,075 A | | 11/1934 | Smith | |
| 2,124,110 A | | 7/1938 | Hall | |
| 2,276,811 A | | 3/1942 | Ward | |
| 2,489,754 A | | 11/1949 | Crinder | |
| 2,625,378 A | * | 1/1953 | Nason | 165/171 |
| 3,799,831 A | * | 3/1974 | Griffiths | 156/297 |
| 3,912,005 A | | 10/1975 | Griffiths | |
| 4,000,140 A | * | 12/1976 | Tierney | 524/69 |
| 4,287,263 A | * | 9/1981 | Woodring et al. | 428/489 |
| 5,906,045 A | * | 5/1999 | Kim | 29/890.07 |
| 6,103,356 A | * | 8/2000 | Messenger | 428/215 |
| 6,536,227 B1 | * | 3/2003 | Lee | 62/440 |
| 2005/0121183 A1 | * | 6/2005 | Neumann | 165/168 |

FOREIGN PATENT DOCUMENTS

| | | |
|---|---|---|
| DE | 198 18 995 A1 | 11/1999 |
| DE | 199 38 773 A1 | 2/2001 |
| EP | 0 697 277 A2 | 2/1996 |
| EP | 0 806 617 A2 | 11/1997 |
| JP | 54132845 A | 10/1979 |
| JP | 57210295 A | 12/1982 |

* cited by examiner

*Primary Examiner*—David P. Bryant
*Assistant Examiner*—Christopher M Koehler
(74) *Attorney, Agent, or Firm*—Russell W. Warnock; Craig J. Loest; James E. Howard

(57) ABSTRACT

A heat exchanger for a refrigerating appliance includes a plate, a conduit tubing, which is placed in thermo-conductive contact with the plate and is provided for transporting a coolant, and a holding material layer that adheres to the plate and to the conduit tubing. The holding material layer is made of a bitumen composition. The heat exchanger can be produced by stacking the plate, the conduit tubing, and a sheet made of the bitumen composition, whereby the holding material layer is formed form the sheet by heating and pressing the stack.

15 Claims, 2 Drawing Sheets

METHOD FOR PRODUCING A HEAT EXCHANGER

CROSS-REFERENCE TO RELATED APPLICATION

This is a continuing application, under 35 U.S.C. § 120, of copending international application No. PCT/EP03/04338, filed Apr. 25, 2003, which designated the United States; this application also claims the priority, under 35 U.S.C. § 119, of German patent application No. 102 18 826.2, filed Apr. 26, 2002; the prior applications are herewith incorporated by reference in their entirety.

BACKGROUND OF THE INVENTION

Field of the Invention

The present invention relates to a heat exchanger, such as an evaporator, a condenser, or the like, for a refrigerator with a base plate, a pipeline for a refrigerant, disposed in heat-conducting contact with the base plate, and a layer of holding material, adhering to the base plate and the pipeline. The present invention also relates to a method for producing such a heat exchanger.

Such heat exchangers and methods for production are known from German Published, Non-Prosecuted Patent Application DE 199 38 773 A1. In this production method, a pipeline that is bent in a meandering manner is held pressed against a base plate, and the intermediate spaces between the meanders of the pipeline are filled with a holding device. This holding device may be an expanded polyurethane foam or, else, pourable thermosetting plastics. Such holding measures are costly, and the cross-linking that takes place while they are curing or expanding makes it difficult for them to be recovered and reused if such an evaporator is to be recycled.

SUMMARY OF THE INVENTION

It is accordingly an object of the invention to provide a heat exchanger for a refrigerator and method for producing a heat exchanger that overcome the hereinafore-mentioned disadvantages of the heretofore-known devices and methods of this general type and that provide an inexpensive heat exchanger for a refrigerator that can be easily recycled and a method for its production.

With the foregoing and other objects in view, there is provided, in accordance with the invention, a heat exchanger for a refrigerator, including a base plate, a pipeline for holding a refrigerant, the pipeline in heat-conducting contact with the base plate, and a layer of holding material adhering to the base plate and to the pipeline, the layer of holding material being of a bitumen composition.

The use of a bitumen composition as the layer of holding material has the advantage, on one hand, that such materials are inexpensively available and, on the other hand, that they can be easily recycled because the bitumen material obtained after breaking up such a heat exchanger into its component parts can be used for producing a new heat exchanger or other purposes without any appreciable reprocessing and without loss of quality. Furthermore, use of the bitumen composition ensures, after it has cooled down, there is an intimate contact of the pipeline with the base plate, whereby the thermal efficiency of the heat exchanger is improved. The mass of the bitumen composition also has a heat- or cold-storing effect, which, in the case of an evaporator, serves the purpose of lowering the energy consumption of a refrigerator.

The connection achieved by the bitumen composition between the base plate and the pipeline can be subjected to great mechanical loads and, consequently, the heat exchanger is dimensionally very stable during handling in the production sequence of a mass production operation.

The conforming properties of the bitumen composition mentioned makes it follow the exact contours of the pipeline and the base plate. As a result, no moisture can diffuse in between the pipeline and the base plate. Thus, a risk of corrosion or of ice formation leading to detachment of the pipeline from the base plate is avoided.

In accordance with another feature of the invention, to promote the heat transfer between the pipeline and the base plate, the pipeline may have a flattened cross-section with a widened side facing the base plate to ensure surface-area contact between the base plate and the pipeline. The surface-area contact ensures heat-conducting contact between the pipeline and the base plate even under unfavorable production conditions.

In accordance with a further feature of the invention, the to achieve a firm connection between the layer of holding material and the base plate, a layer of adhesive, which bonds the layer of holding material to the base plate, at least locally may, preferably, be provided.

This layer of adhesive, preferably, is of an adhesive that can be activated by heat. This simplifies the production of the heat exchanger because the layer of adhesive can be applied in advance in an unprotected state to a sheet of the bitumen composition used for forming the layer of holding material and because it gains its effectiveness by melting when the layer of holding material is heated.

Apart from bitumen, the bitumen composition may contain between approximately 50% and approximately 80% of filler. The filler, which may be a single material or a mixture of materials, may be selected, for example, from the aspect of minimizing costs or improving the thermal conductivity. A preferred filler is powdered stone.

In accordance with an added feature of the invention, for protection, the layer of holding material may be provided with a layer of lacquer on its side facing away from the base plate.

In accordance with an additional feature of the invention, the layer of holding material expediently has an average thickness in the range between approximately 0.5 and 2 mm, preferably, between approximately 1.0 and 1.5 mm.

With the objects of the invention in view, there is also provided a in a refrigerator having a housing, a heat exchanger including a base plate disposed in the housing, a pipeline for holding a refrigerant, the pipeline in heat-conducting contact with the base plate, and a layer of holding material adhering to the base plate and to the pipeline, the layer of holding material being of a bitumen composition.

With the objects of the invention in view, there is also provided a method for producing a heat exchanger, including the steps of forming a stack having a base plate, a pipeline for holding a refrigerant, the pipeline being in heat-conducting contact with the base plate, and a sheet of holding material adhering to the base plate and to the pipeline, the sheet of holding material being of a bitumen composition, and heating the sheet and compressing the stack.

The production of a heat exchanger of the type described above is possible in a simple way by forming a stack that includes a base plate, a pipeline for a refrigerant, and a sheet of a bitumen composition and by, subsequently, heating the sheet and compressing the stack.

In accordance with yet another mode of the invention, the heat exchanger is an evaporator or a condenser.

In accordance with a concomitant mode of the invention, the base plate, the pipeline, and the sheet of the bitumen composition are stacked in this sequence.

Other features that are considered as characteristic for the invention are set forth in the appended claims.

Although the invention is illustrated and described herein as embodied in a heat exchanger for a refrigerator and method for producing the heat exchanger, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
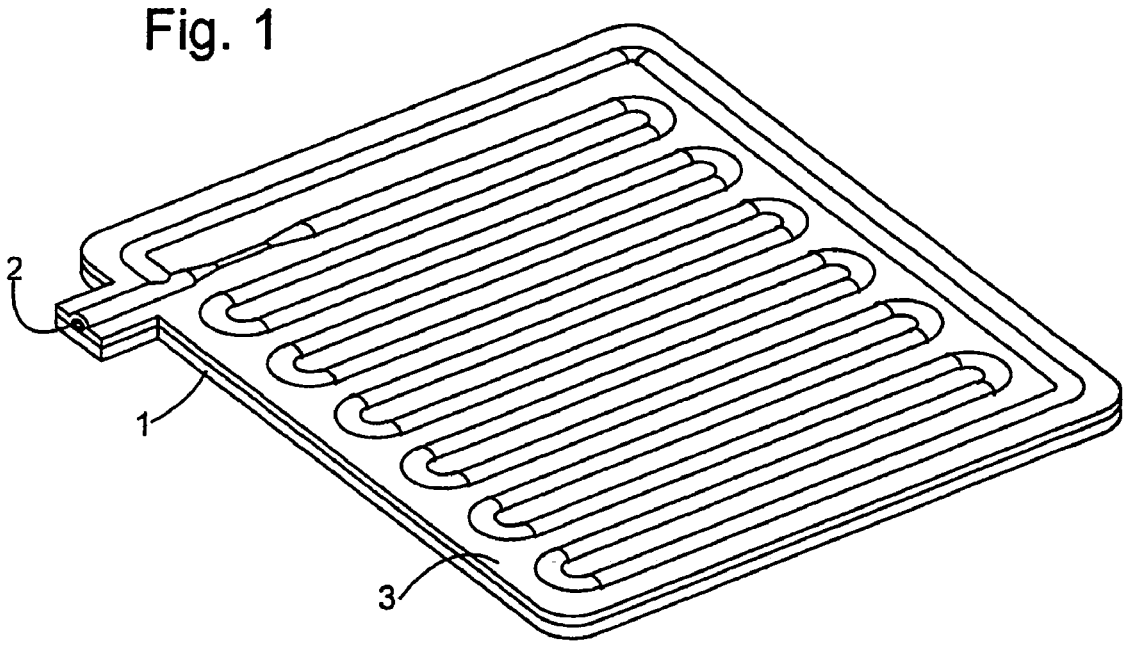
FIG. 1 is a perspective view of an evaporator according to the invention.

Referring now to the figures of the drawings in detail and first, particularly to FIG. 1 thereof, there is shown an evaporator constructed from a planar base plate 1 of aluminum sheet. On the sheet is a refrigerant line 2, including a pipe likewise of aluminum, which is configured in a meandering manner. The base plate 1 and the refrigerant line 2 are covered by a layer 3 of holding material of a bitumen composition. This includes approximately 25% of polymer-modified bitumen, approximately 3% of a polymer, and approximately 72% of powdered stone.

Figure 2:
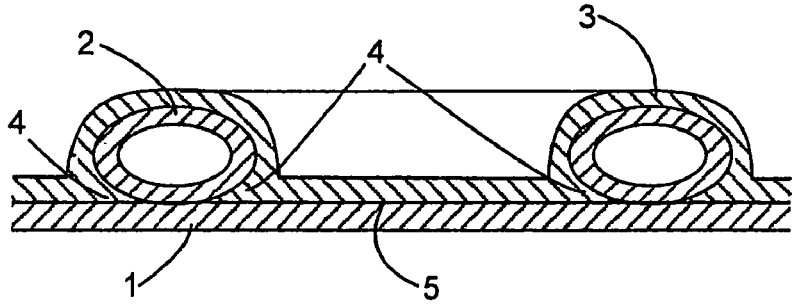
FIG. 2 is a fragmentary, cross-sectional view through a portion of the evaporator of FIG. 1.

As FIG. 2 shows, the refrigerant line 2 does not have an exactly round cross-section, but a flattened cross-section, whereby the refrigerant line 2 and the base plate 1 touch each other with at least approximately surface-area contact. As a result, a heat-conducting contact is achieved between the refrigerant line 2 and the base plate 1 in a simple manner in terms of production. The layer of holding material 3 extends into interstices 4 that lie on both sides of the contact line between the refrigerant line 2 and the base plate 1. The solid layer of holding material 3 provides a better heat transfer between the base plate 1 and the refrigerant line 2 than would be possible with the conventional use of a polyurethane foam as holding material. The flattened form of the refrigerant line 2 provides a smaller thickness of the layer of holding material 3 in the interstices 4 than would be the case with a round line 2. This is favorable likewise for an efficient heat exchange between the base plate 1 and the refrigerant line 2. Between the layer of holding material 3 and the base plate 1, there is a layer 5 of a hot-melt adhesive, which, because of its much smaller thickness in comparison with the base plate 1 and the layer of holding material 3, can only be seen as a line in the FIG. 2.

Figure 3:
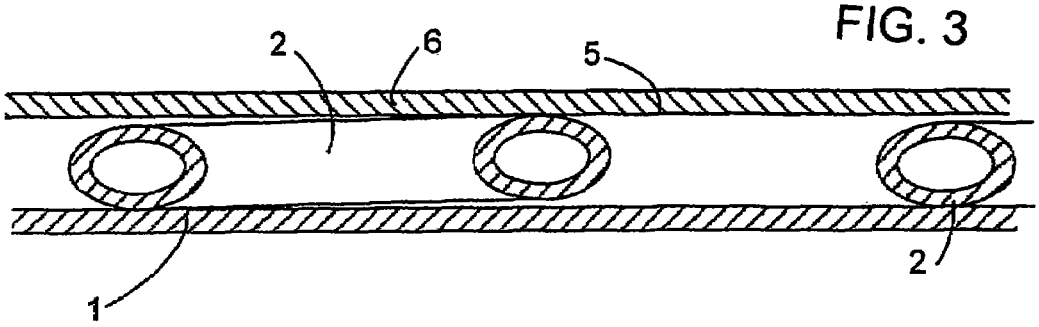
FIGS. 3, 4, and 5 are fragmentary, cross-sectional views through a portion of the evaporator according to the invention in various process steps for producing the evaporator.
Figure 4:
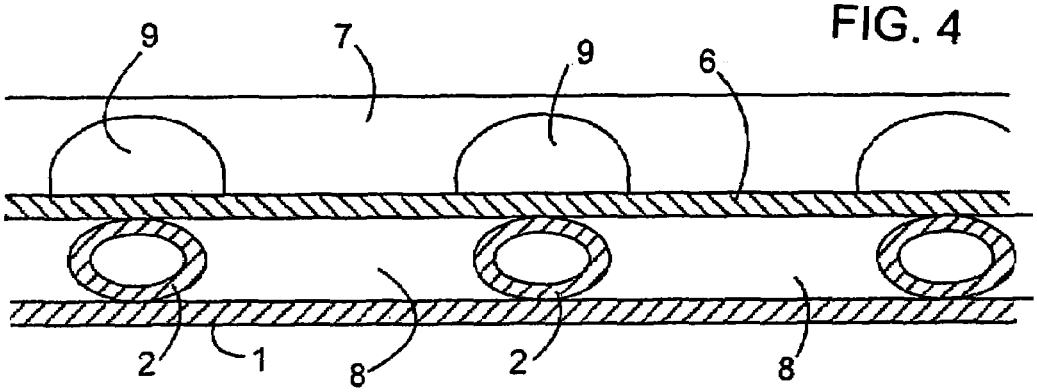
Figure 5:
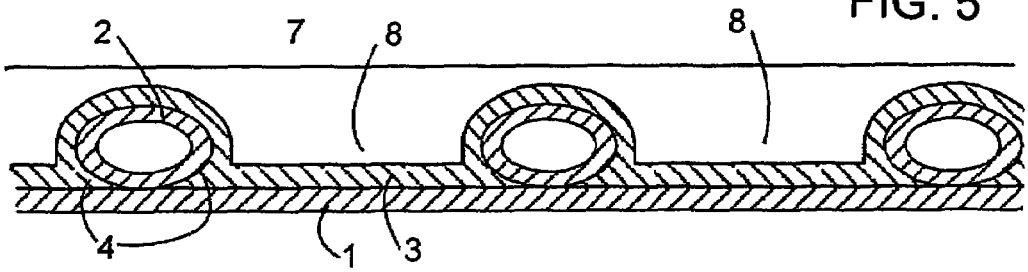

Individual steps of the production of the evaporator according to the invention are represented in FIGS. 3, 4, and 5.

In a first method step shown in FIG. 3, a stack is formed, the layers of which respectively include the base plate 1, the refrigerant line 2, and a 1.2 mm thick sheet 6 of the bitumen composition. On the underside of the sheet 6 facing the base plate 1 and the refrigerant line 2 there is the layer of adhesive 5. Because the adhesive of the layer 5 does not adhere to the sheet in the cold state, the sheet 6, together with the layer 5, can be easily prefabricated and handled; measures to protect the adhesive power for the time between production and use of the sheet 6 are not necessary.

In the phase of producing the evaporator that is shown in FIG. 3, the refrigerant line 2 does not yet have to rest on the base plate 1 over its entire length; a slight undulation of the refrigerant line 2 perpendicular in relation to the surface of the base plate 1, as shown in FIG. 3, is permissible.

In a second step of producing the evaporator that is shown in FIG. 4, a die 7 is pressed against the upper side of the sheet 6. In this stage, the sheet 6 is cold and, consequently, rigid; the pressing force of the die 7 has the effect that the refrigerant line 2 is pressed against the base plate 1 over its entire length.

The die 7 is provided on its underside, facing the sheet 6, with channels 9. The path of these channels 9 corresponds to that of the refrigerant line 2. As an alternative thereto, the die 7 may also be produced from elastomeric polymer, such as, for example, silicone with a hardness of, for example, 20 Shore A and a material thickness of 20 mm. In the case of a die made of elastomeric polymer with an adapted Shore hardness, so as not to cause the refrigerant line any damage, there is no need for the channel path of the refrigerant hardening to be introduced on the underside of the die.

Subsequent heating makes the bitumen of the sheet 6 become free flowing, and the sheet 6 is pressed against the base plate 1 in the intermediate spaces 8 between neighboring portions of the refrigerant line 2. The viscosity of the bitumen composition is set such that, on one hand, it becomes free-flowing enough to penetrate into the interstices 4 between the base plate 1 and the refrigerant line 2, but, on the other hand, is still viscous enough to prevent parts of the refrigerant line 2 from becoming re-detached locally from the base plate 1.

To rule out the possibility of local re-detachment of the refrigerant line 2 independently of the free-flowing capability of the bitumen-composition, the channels 9 of the die 7 may also be provided locally with non-illustrated projections that are pressed through the sheet 6 when the latter is heated and come into direct contact with the refrigerant line 2 to keep it pressed against the base plate 1.

The melting point of the hot-melt adhesive of the layer of adhesive 5 is chosen such that it melts during the heating and shaping of the sheet 6 and, therefore, after cooling down, bonds the re-solidified layer of holding material 3 firmly to the base plate 1 and the refrigerant line 2. The layer of adhesive 5 may extend over the entire underside of the sheet 6 or only over parts of it.

For sealing the exposed surface of the layer of holding material 3, a layer of lacquer, in particular of shellac, may be applied.

The recovery of the bitumen composition during recycling of the evaporator is possible in a simple way, in that the layer of holding material 3, which is brittle in the cold state, is made to come away in pieces by deforming the evaporator or in that the bond between the layer of holding material 3 and the refrigerant line 2 or base plate 1 is made to rupture by extreme cooling of the evaporator, for example, with the aid of dry ice.

We claim:

1. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die;

applying a force on the sheet of holding material with the die to press the sheet of holding material and the pipeline against the base plate and adhering the sheet of holding material to the base plate and the pipeline;

heating the sheet of holding material; and wherein the act of applying a force on the sheet of holding material is started before the act of heating the sheet of holding material.

2. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die;

applying a force on the sheet of holding material with the die to press the sheet of holding material and the pipeline against the base plate and adhering the sheet of holding material to the base plate and the pipeline; and providing a heat activated adhesive on an inner side of the sheet of holding material facing the base plate, the adhesive adhering the sheet of holding material to the base plate.

3. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die;

applying a force on the sheet of holding material with the die to press the sheet of holding material and the pipeline against the base plate and adhering the sheet of holding material to the base plate and the pipeline; and applying a sealing material on an outer side of the sheet of holding material facing away from the base plate.

4. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die;

applying a force on the sheet of holding material with the die to press the sheet of holding material and the pipeline against the base plate and adhering the sheet of holding material to the base plate and the pipeline; and wherein the die is formed from a rigid material and includes channels formed in a side of the die facing the baseplate, the channels corresponding to the path of the pipeline and receiving the pipeline within the channels when applying the force on the sheet of holding material with the die.

5. The method according to claim 4, wherein the bitumen composition includes between about 50% and 80% of powdered stone filler.

6. The method according to claim 4, wherein the bitumen composition includes between about 20% and 30% of polymer-modified bitumen.

7. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die;

applying a force on the sheet of holding material with the die to press the sheet of holding material and the pipeline against the base plate and adhering the sheet of holding material to the base plate and the pipeline; and wherein the die is formed from an elastomeric polymer material.

8. The method according to claim 7, wherein the die is formed from silicone and has a hardness of about 20 Shore A.

9. The method according to claim 8, wherein the die has a material thickness of about 20 mm.

10. A method for producing a heat exchanger comprising the acts of:

providing a base plate and a pipeline for holding a refrigerant, the pipeline being in heat-conducting contact with the base plate;

providing a sheet of holding material including a bitumen composition;

providing a die formed from a rigid material and including channels formed in a side of the die facing the baseplate, the channels corresponding to the path of the pipeline;

applying a force on the sheet of holding material with the die to press the sheet of holding material and the pipeline against the base plate, the channels of the die receiving the pipeline within the channels when applying the force on the sheet of holding material with the die; and heating the sheet of holding material.

11. The method according to claim 10, wherein the act of applying a force on the sheet of holding material is started before the act of heating the sheet of holding material.

12. The method according to claim 10, further comprising providing a heat activated adhesive on an inner side of the sheet of holding material facing the base plate, the adhesive adhering the sheet of holding material to the base plate.

13. The method according to claim 10, further comprising applying a sealing material on an outer side of the sheet of holding material facing away from the base plate.

14. The method according to claim 10, wherein the bitumen composition includes between about 50% and 80% of powdered stone filler.

15. The method according to claim 10, wherein the bitumen composition includes between about 20% and 30% of polymer-modified bitumen.

* * * * *